US012135154B2

(12) United States Patent
Dominique

(10) Patent No.: US 12,135,154 B2
(45) Date of Patent: Nov. 5, 2024

(54) PORTABLE REFRIGERANT MANAGEMENT SYSTEM

(71) Applicant: Andy Dominique, Clair (CA)

(72) Inventor: Andy Dominique, Clair (CA)

( * ) Notice: Subject to any disclaimer, the term of this patent is extended or adjusted under 35 U.S.C. 154(b) by 146 days.

(21) Appl. No.: 17/803,653

(22) Filed: Sep. 28, 2022

(65) Prior Publication Data

US 2023/0108388 A1 Apr. 6, 2023

Related U.S. Application Data

(60) Provisional application No. 63/360,445, filed on Oct. 4, 2021.

(51) Int. Cl.
*F25B 45/00* (2006.01)
*F25B 43/00* (2006.01)

(52) U.S. Cl.
CPC ..... *F25B 45/00* (2013.01); *F25B 43/003* (2013.01)

(58) Field of Classification Search
CPC .. F25B 45/00; F25B 43/003; F25B 2345/002; F25B 2345/001; F25B 2345/004; F25B 2345/0051
See application file for complete search history.

(56) References Cited

U.S. PATENT DOCUMENTS 4,285,206 A 8/1981 Koser
4,809,520 A 3/1989 Manz et al.
5,226,300 A 7/1993 Christensen et al.
5,247,802 A 9/1993 Maniez et al.
5,339,642 A * 8/1994 Laukhuf ..... F25B 45/00 62/149
5,479,788 A 1/1996 Roegner
5,560,215 A * 10/1996 Talarico ..... F25B 45/00 62/468
5,802,859 A * 9/1998 Zugibe ..... G01G 17/06 62/149
5,934,091 A 8/1999 Hanson et al.
(Continued)

FOREIGN PATENT DOCUMENTS

CA 2496257 11/2005
CN 104747411 B * 1/2019 ..... F04B 39/121
(Continued)

*Primary Examiner* — Kun Kai Ma
(74) *Attorney, Agent, or Firm* — Mario Theriault

(57) ABSTRACT

The refrigerant management system has a service port connection, refrigerant treatment elements and a wet circuit connecting the service port connection to the refrigerant treatment elements. The refrigerant treatment elements are comprised of a refrigerant filter, a compressor, a condenser coil and a tank. The tank has tank head manifolds mounted thereto. The filter, the compressor and the condenser coil being mounted to the tank and connected to the tank head manifolds by respective pairs of tubing. The wet circuit being partially incorporated inside the tank head manifolds and inside the tank between the tank head manifolds. The first tank head manifold connects the service port connection to the refrigerant filter. The second tank head manifold connects the compressor to the condenser coil and to the tank. Conduits inside the tank extending between the first and second tank head manifolds connect the refrigerant filter to the compressor.

17 Claims, 5 Drawing Sheets

(56) References Cited

U.S. PATENT DOCUMENTS

| | | | | |
|---|---|---|---|---|
| 6,244,055 | B1 * | 6/2001 | Hanson | B60H 1/00585 62/85 |
| 6,318,100 | B1 | 11/2001 | Brendel et al. | |
| 6,408,637 | B1 | 6/2002 | Hanson et al. | |
| 6,460,354 | B2 | 10/2002 | Yabuki et al. | |
| 7,010,927 | B2 | 3/2006 | Lifson et al. | |
| 7,086,237 | B2 | 8/2006 | Arshansky et al. | |
| 7,124,594 | B2 | 10/2006 | McRell | |
| 8,627,676 | B2 | 1/2014 | Thiessen et al. | |
| 8,740,582 | B2 | 6/2014 | Rabe | |
| 8,800,306 | B2 * | 8/2014 | Schoenoff | F04B 9/047 62/77 |
| 9,447,998 | B2 | 9/2016 | McMasters et al. | |
| 9,593,873 | B2 | 3/2017 | Lundberg | |
| 10,088,202 | B2 | 10/2018 | Huff et al. | |
| 10,807,438 | B2 | 10/2020 | Hs | |
| 10,837,446 | B2 | 11/2020 | Hong | |
| 2014/0182684 | A1 | 7/2014 | McMasters | |
| 2015/0153082 | A1 * | 6/2015 | Lundberg | F25B 43/006 62/85 |
| 2015/0153083 | A1 * | 6/2015 | McMasters | F25B 45/00 62/149 |
| 2016/0123641 | A1 * | 5/2016 | McMasters | F25B 45/00 62/149 |
| 2016/0123642 | A1 * | 5/2016 | Murray | F25B 45/00 62/149 |
| 2016/0138843 | A1 * | 5/2016 | Lundberg | F25B 45/00 62/149 |
| 2016/0169569 | A1 * | 6/2016 | Lundberg | G01F 1/34 62/149 |
| 2016/0169570 | A1 * | 6/2016 | Lundberg | F16L 37/0925 137/561 A |
| 2016/0187042 | A1 * | 6/2016 | Brown | F25B 45/00 62/77 |
| 2017/0191719 | A1 * | 7/2017 | Plasek | B60H 1/00585 |
| 2018/0120008 | A1 * | 5/2018 | Brown | F25B 45/00 |
| 2019/0093930 | A1 * | 3/2019 | McMasters | F25B 41/20 |
| 2021/0003332 | A1 * | 1/2021 | Nakagawa | F25B 43/003 |

FOREIGN PATENT DOCUMENTS

| | | | | |
|---|---|---|---|---|
| CN | 112728818 A | * | 4/2021 | B60H 1/3211 |
| GB | 2595898 | | 12/2021 | |

* cited by examiner

PORTABLE REFRIGERANT MANAGEMENT SYSTEM

The present application claims the benefit of U.S. Provisional Application No. 63/360,445, filed Oct. 4, 2021.

FIELD OF THE PRESENT INVENTION

The present invention pertains to the field of refrigerant management systems, and more particularly, it pertains to a portable device capable of automating the process of recovering refrigerant from an appliance, filtering the refrigerant, measuring the quantity of refrigerant recovered, recharging the purified refrigerant into the appliance and keeping records of the service done.

BACKGROUND OF THE PRESENT INVENTION

Refrigerant management systems are used to recover, recycle and recharge refrigerant contained in household and commercial refrigerators, air conditioning system; automotive air conditioning systems and heat pumps. These refrigerant management systems are also used to measure the amount of refrigerant in a refrigeration device, remove oil and other impurities from the refrigerant and replenish the refrigeration device when some refrigerant has been lost.

The refrigerant management systems used in the past are large, heavy, mounted on wheeled carts and difficult to manipulate in equipment rooms of industrial buildings, or around residential landscapes for examples. There is a need in this industry for a smaller refrigerant management system that can transported by one person and easily operated without using an extensive array of tools, hoses, containers and connectors. The portability of a refrigerant management system and the improvements made to reduce the size and weight of these systems are the focus of the present invention.

The prior art contains portable refrigerant management devices as will be appreciated from the disclosures of the following documents.

U.S. Pat. No. 5,226,300 issued to J. P. Christensen et al. on Jul. 13, 1993;

U.S. Pat. No. 5,247,802 issued to M. J. Maniez et al., on Sep. 28, 1993;

U.S. Pat. No. 8,740,582 issued to G. H. Rabe on Jun. 3, 2014;

In the Maniez et al. portable device, the internal tank to receive the recovered refrigerant has been reduced to hold about 4 lbs of refrigerant, in order to keep the weight of the apparatus under 50 lbs. In the other two documents cited above, the portable versions of the devices described do not contain a receiving tank incorporated in the unit. These machines use separate exterior tanks to receive the refrigerant recovered.

Therefore, it is believed that there is a market demand for a portable refrigerant management system that contains a refrigerant recovery tank of a fair volume incorporated therein.

SUMMARY OF THE PRESENT INVENTION

In the present refrigerant management system, there is provided a portable refrigerant management system comprising a compressor, a filter, a condenser, a microprocessor and a storage tank of a fair size to accommodate common residential appliances.

In a first aspect of the present invention, there is provided a tank for use in a refrigerant management system. This tank is made of a hollow structure, first and second tank head manifolds mounted to respective ends of the hollow structure and conduits extending inside the hollow structure connecting the first tank head manifold to the second tank head manifold.

In another aspect of the present invention, there is provided a refrigerant management system comprising: a service port connection, a refrigerant filter; a compressor; a condenser coil and a tank. A first tank head manifold is mounted to the tank and connects the service port connection to the refrigerant filter. A second tank head manifold is mounted to the tank and connects the compressor to the condenser coil and to the tank. The refrigerant management system also includes conduits inside the tank extending between the first and second tank head manifolds and connecting the refrigerant filter to the compressor.

The refrigerant management system has a light weight, it is portable and it has a tank volume to accept refrigerant contained in common residential appliances.

In yet a further aspect of the present invention, there is provided a refrigerant management method comprising the steps of:

- using a compressor, pulling refrigerant from an outside appliance, through a service port and through a filter;
- passing the refrigerant through the compressor; compressing the refrigerant; and forcing the refrigerant through a condenser coil and into a storage tank;
- weighing the refrigerant in the tank;
- pulling the refrigerant from the tank, passing the refrigerant through the compressor, forcing the refrigerant through the filter, through the service port and into the outside appliance.

In another aspect, of the present invention, the refrigerant management method comprises the additional step of:

- using the compressor, purging refrigerant from the filter, from the condenser coil, from the tank and from conduits between the filter, the compressor, the condenser coil and the tank, after the step of passing the refrigerant through the service port and into the outside appliance.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

The preferred embodiment of the portable refrigerant management system will now be described with the aid of the accompanying drawings, in which like numerals denote like parts throughout the several views, and in which.

In the illustrations, the legend for the labels is as follows:

C: compressor;
C1: compressor connection;
C2: compressor connection;
CC: condenser coil;
CC1: condenser coil connection;
CC2: condenser coil connection;
F: reversible flow filter
F1: filter connection;
F2: filter connection
H1: first tank head manifold;
H2: second tank head manifold;
MC: microprocessor;
P1: service port;
P2: refill Port;
P3: flush port;
P4: purge port;
PS1: pressure sensor no. 1;
PS2: pressure sensor no. 2;
PS3: pressure sensor no. 3;
S: solenoid-operated valve;
SC: electronic scale
T: storage tank or reservoir;
TL: tank liquid connection;
TG: tank gas connection;
TS1: temperature sensor no. 1.
TS2: temperature sensor no. 2;
TS3: temperature sensor no. 3
Numerals 1-10 are solenoids-operated valves;

DETAILED DESCRIPTION OF THE PREFERRED EMBODIMENT

Many components of the preferred installation were not illustrated to facilitate the understanding of the basic concept of the design. The components that were not illustrated are those for which the nature, mountings and functions would be obvious to the person skilled in the art of refrigerant management systems in general.

Figure 1:
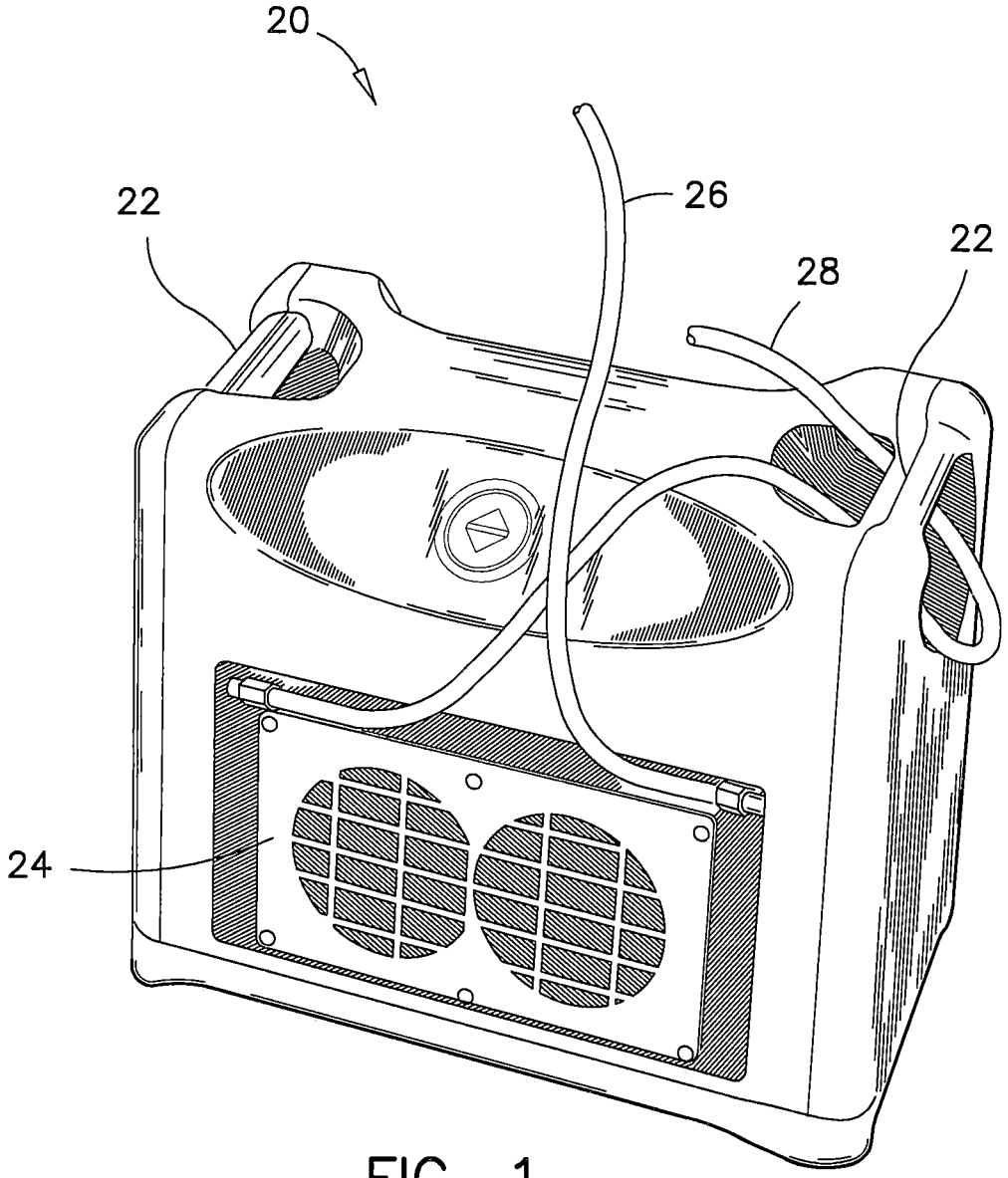
FIG. 1 illustrates a typical case in which the portable refrigerant management system can be mounted.

Referring now to FIG. 1, the case 20 of the present refrigerant management system is illustrated. This case 20 is large enough to contain the elements of the refrigerant management system according to the preferred embodiment of the present invention. The case 20 is considered an integral part of the preferred refrigerant management system.

The case 20 is illustrated for example only, to describe the portability of the preferred system. The case 20 has two handles 22, air vent openings 24, a service hose 26, and a top-up tank hose 28. As illustrated, the hoses 26, 28, are foldable under the handles 22 when transporting the preferred refrigerant management system from a service truck, for example and into a client's residence and vice-versa.

Figure 2:
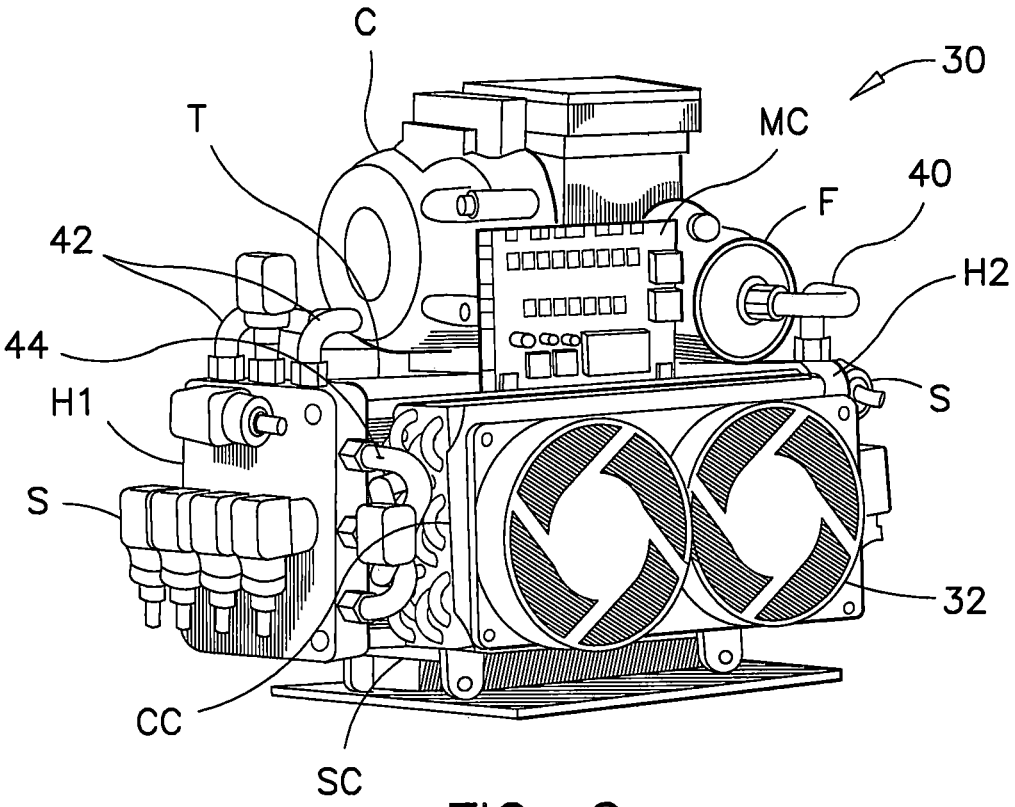
FIG. 2 is a rendered image of a perspective view of the portable refrigerant management system viewed without the case of FIG. 1.

Referring to FIG. 2, the core of the preferred refrigerant management system 30 can be seen. A hollow structure such as a cylindrical tank or reservoir T has two manifold plates H1 and H2 incorporated therewith and forming the heads of the tank T. The wet circuit of the present refrigerant management system is partly incorporated in these two manifolds.

Solenoid valves S are mounted directly to the tank head manifolds H1 and H2. A compressor C and a filter F are mounted atop the tank T next to each other. The filter F is a reversible filter capable of filtering refrigerant flowing from the service hose 26 to the compressor C, and back from the compressor C into a client's appliance, as will be explained herein. The compressor C is a variable speed-type compressor, preferably having a light-weight aluminum body.

The condenser coil CC is mounted to the tank T, alongside the tank T. Compact fans 32 are mounted to the condenser coil CC to accelerate the condensation of the refrigerant passing through the condenser coil CC. There is also provided an electronic micro-controller MC which controls the operation of the system 30. An electronic scale SC, in the form of strain gauge load cells or equivalent, is mounted under the entire assembly to determine the content of the tank T by weight.

It is to be noted that the tubing in this system is limited to short pieces of tubing between the tank head manifolds H1 and H2 and the connected elements, thereby reducing the volume and weight of the system considerably.

Figure 3:
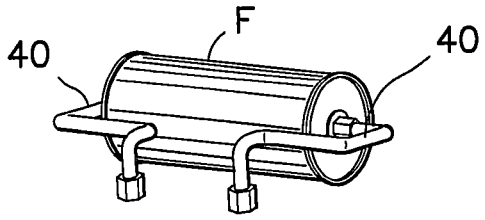
FIG. 3 is an illustration of the refrigerant filter mounted in the preferred portable refrigerant management system, showing preferred pieces of tubing to and from the filter and to and from other connected elements.

In that regard, FIG. 3 illustrates the preferred type of tubing used to connect the elements of the preferred system to one of the tank head manifolds H1, H2. The pieces of tubing 40 are shorter than the length of the filter F. These pieces of tubing 40 are both connected to the manifold H2 on the same plane of the manifold H2, and at close proximity from each other. The pieces of tubing 40 are mirror images of each other. It will be appreciated that when the filter F needs to be replaced, it is very easy to remove it from the manifold H2 without having to undo any other fittings or to move any other element.

Similarly, the pieces of tubing 42 to and from the compressor C are mounted side by side on a same plane of the manifold H1. The pieces of tubing 44 to and from the condenser coil CC are shorter than the length of the condenser coil CC and are mounted side by side on a same plane of the manifold H1. As can be seen in FIG. 2, the pieces of tubing 42 and 44 are mirror images of each other in each pair, at least at their connecting ends. As a result, the filter F, the compressor C, and the condenser coil CC are easily serviceable without undoing other fittings or without moving any unrelated component. The elements of the preferred refrigerant management system 30 are thereby easy to assemble. The preferred refrigerant management system has a relatively large reservoir or tank T, although the preferred system is compact and relatively light weight. The preferred tank volume is 3.8 Litres. The preferred refrigerant management system 30, with its case 20 weighs about 55 lbs.

Figure 4:
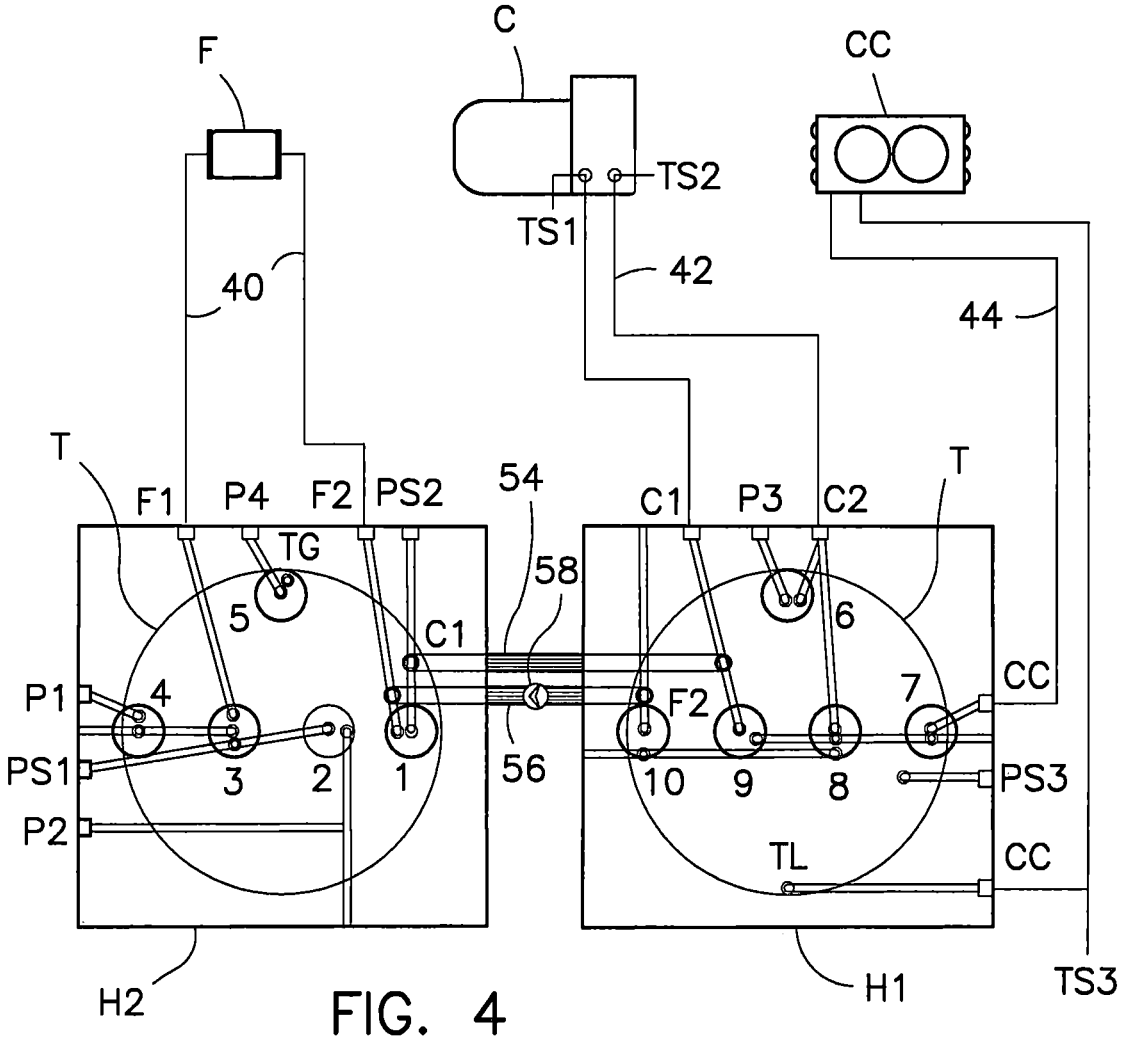
FIG. 4 is a schematic illustration of the wet circuit in and between the tank head manifolds.

Referring specifically to FIG. 4, it will be appreciated that all valve-to-valve passages or conduits are included in and between both tank head manifolds H1 and H2. Any piece of tubing in the preferred portable refrigerant management system is limited to short segments between one of tank head manifolds H1, H2, and the connected elements.

Conduits 54, 56 connecting the filter F to the compressor C extend inside the tank T between the tank head manifolds H1, H2. Conduit 54 connects the outlet of the filter F to the inlet of the compressor C and conduit 56 connects the outlet of the compressor C to the outlet of the filter F, when this outlet becomes an inlet in a reversed flow mode. This feature further reduces the size of the preferred management system 30, and the number of hindrances to overcome when servicing one of the elements mounted to the tank T.

In FIGS. 5, 6, 7 and 8, the individual solenoid-operated valves S are labelled 1 to 10. The diagrams illustrated in these figures disclose modes of operation of the preferred refrigerant management system 30. In FIGS. 5, 6, 7 and 8, symbols of electric switches are used to describe the direction of flow in the circuit. It will be appreciated that the electrical analogy was also used. A closed switch symbol indicate flow through, and an open switch symbol indicates no-flow.

The micro-controller MC is operable from commands of a user device such as a smart phone or a tablet through a wireless connection. This also obviates the need for gauges, knobs and all the associated hardware in the preferred embodiment.

Figure 5:
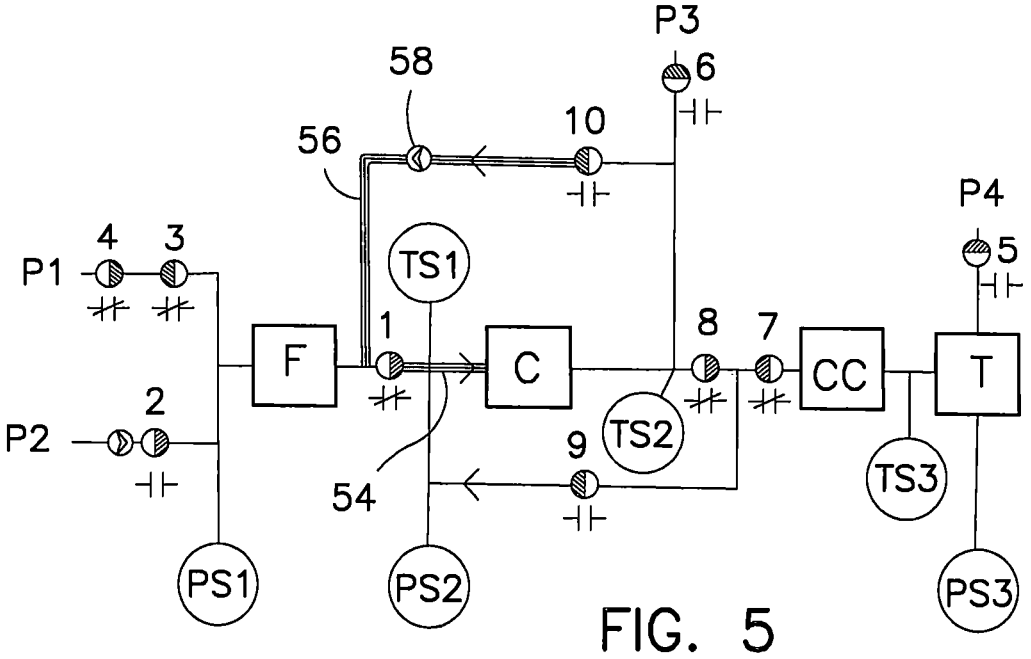
FIGS. 5, 6, 7 and 8 are schematic illustrations of the refrigerant flow circuit of the portable refrigerant management system showing the valve positions in a refrigerant recovery mode; in a refrigerant return mode; in a refrigerant top-up mode, and in a refrigerant flushing mode respectively.

Recovery mode, FIG. 5: The client's refrigeration system is connected to the service port connection P1, via hose 26. Solenoid valves (3), (4), (1), (8) and (7) are opened to flow in this mode. In this recovery mode, the compressor C is the driving force to move the refrigerant by suction from the client's device. Solenoid valve (1) is pulsated to manage the flow of refrigerant passing through the compressor C. The pulsation of the solenoid valve (1) is controlled by the micro-processor MC, in response to the amperage on the compressor motor C, the refrigerant state and the increase in weight in the tank T, indicated by the scale SC. This pulsation of solenoid valve (1) is effected to ensure that the load applied to the compressor does not exceed the rated flow capacity of the compressor C.

A first pressure sensor PS1 is connected to the service port to determine the inlet pressure. Filter F is mounted in series with the suction side of the compressor C. When valves (1), (4) and (3) are open to flow, the compressor C is operated to draw refrigerant from a client's appliance through the first filter F, to remove impurities from the refrigerant. Temperature sensors TS1 and TS2 are connected to the inlet and outlet of the compressor C to monitor the temperature and refrigerant state at these locations. The refrigerant under pressure is fed through the condenser coils CC, and into the tank T.

A flush port P3 is provided to purge the residual refrigerant left in the system to an external tank.

Temperature and pressure sensors TS3 and PS3, are connected to the tank T. When the pressure-temperature gradient indicated by these sensors, does not correspond to an ideal PT chart, the solenoid valve (5) is opened to flow to evacuate air or other gaseous substances from the tank, through purge port P4.

Figure 6:
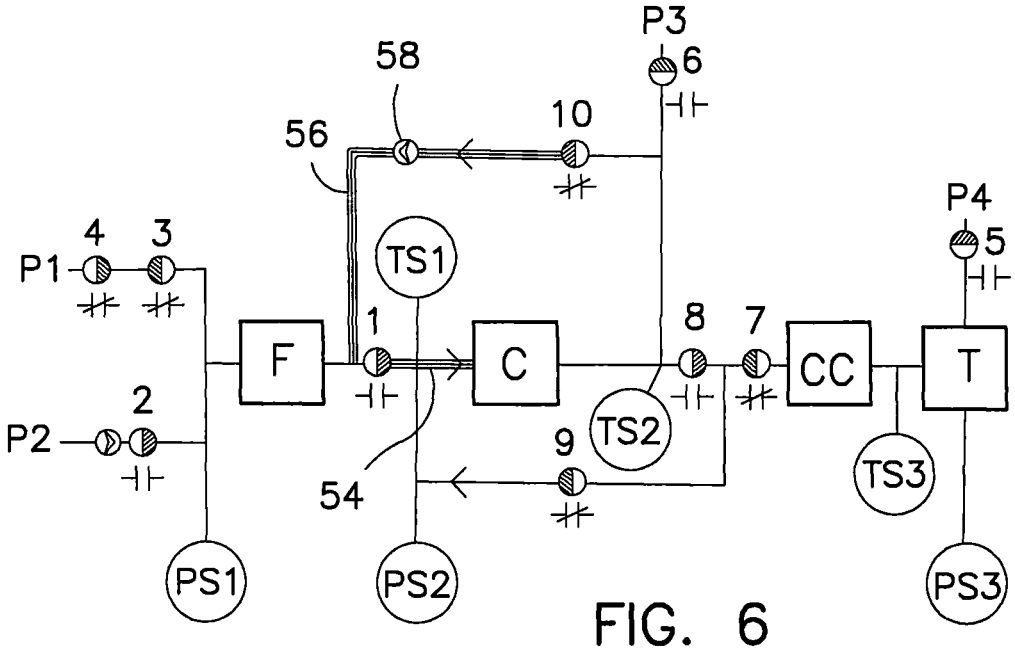

Refrigerant-Return Mode, FIG. 6

When the refrigerant from the client's refrigeration device has been filtered and measured, it is returned to the clients' device using the same connection through the service port P1, and hose 26. During this process, solenoid valves (7), (9), (10), (4) and (3) are opened to flow, allowing the refrigerant to pass through the condenser coil CC, into the compressor C, through the loop of valve (9), around the loop of valve (10), through the filter F and through solenoid valve (4) and the service port P1. In the return mode, the compressor C is also the driving force to move the refrigerant. In the return mode, solenoid valve (9) is pulsating to manage the amount of refrigerant passing through the compressor C, as explained previously. As also mentioned, the filter F is a reversible flow filter which has a same efficiency whether the flow pass through it one way of the other. A major advantage of the circuit in the return mode is that impurities that may have been generated in the present system are removed before the refrigerant is pumped into the client's refrigeration device.

Figure 7:
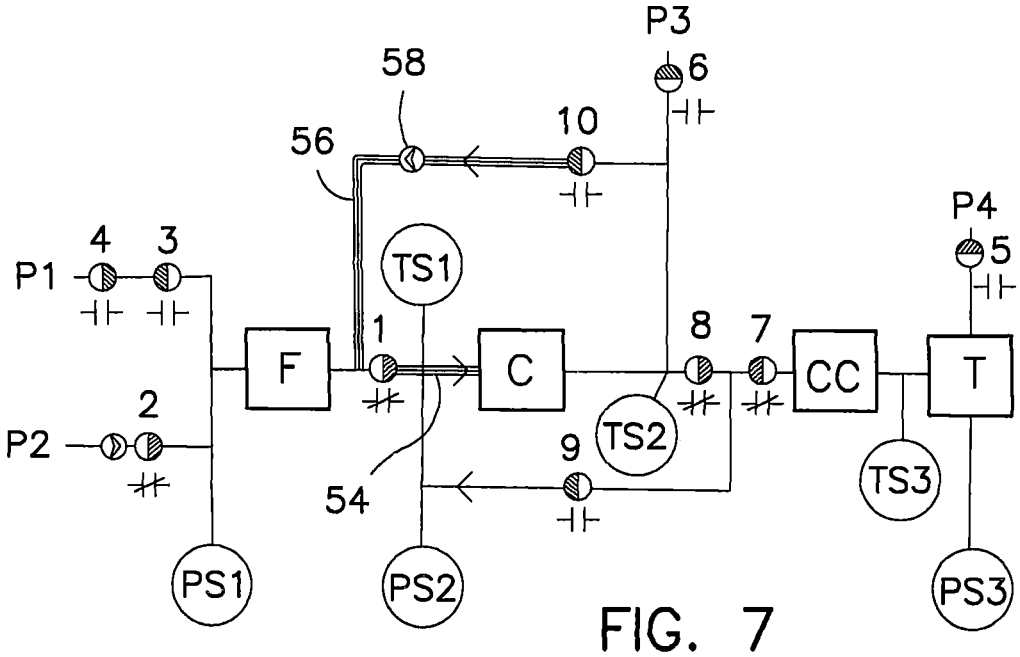

Refrigerant Top-Up Mode: FIG. 7

Whenever the amount of refrigerant found in the tank T is insufficient to fill the client's refrigeration device, a top-up tank or fresh refrigerant reserve container can be connected to the refill or fresh refrigerant reserve container port P2 to add more refrigerant in the tank T. In this mode valves (2), (1), (8) and (7) are opened to flow. When the proper amount of refrigerant is found in the tank T, the content of the tank T can be transferred into the client's refrigeration device using the wet circuit of the return mode as illustrated in FIG. 5.

Figure 8:
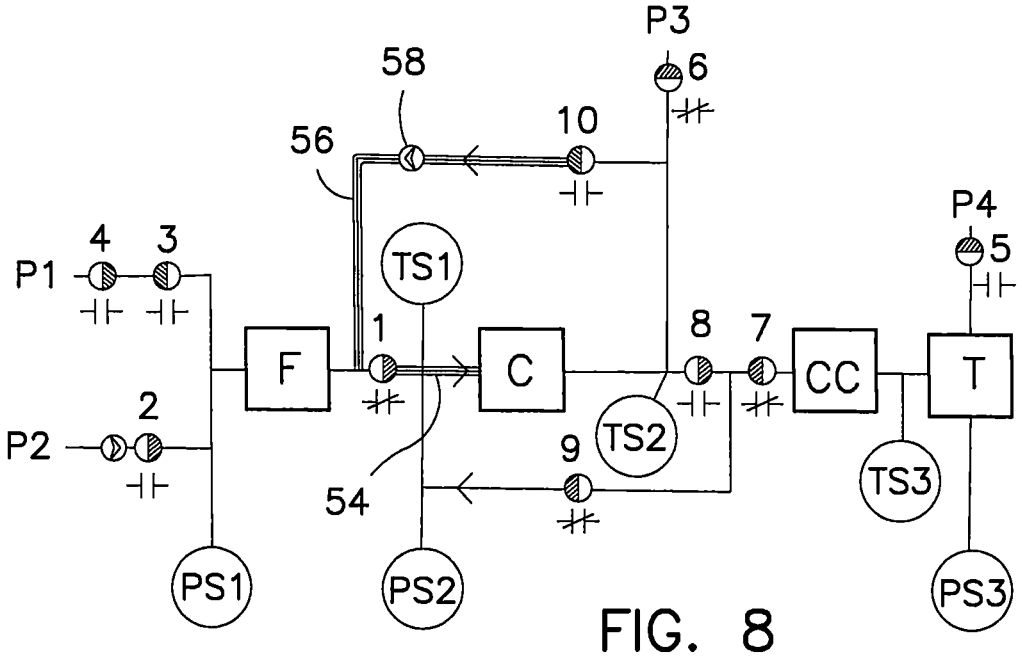

Flushing Mode: FIG. 8

Referring to the wet circuit of FIG. 8, solenoid valve (1) is opened to flow to connect the filter F, the first conduit 56 and the second conduit 54 to the suction of the compressor C. Valves (7) and (9) are opened to flow to connect the condenser coil CC and the tank T to the suction of the compressor C. Valve (6) is opened to flow to connect the discharge of the compressor C to the flush port P3. The compressor C is operated to draw residual refrigerant from the filter F, from the conduits 54, 56, from the condenser coil CC and from the tank T, and from both tank head manifolds H1 and 112, and to discharge this residual refrigerant in an appropriate container connected to the flush port P3. This flushing cycle prevents the contamination from one refrigeration system to another between two service jobs.

The compactness and light weight of the present system is due principally to the elimination of hoses and fittings, the elimination of gauges and knobs, the elimination of metering and regulating devices. Such simplification was made possible by the introduction and innovative design of the following elements:

- two manifolds H1, and H2 integrated within the heads of the tank T;
- the wet circuit built inside the manifolds H1, H2, and inside the tank T, between the manifolds H1, H2.
- the wet circuit enabling recovery and recharge using the same service port connection;
- a wireless smart device connection;
- a combination of temperature sensors, pressure sensors and a scale;
- a microprocessor with an amperage, pressure, temperature and weight-reading chips;
- an algorithm inside one of the microprocessor chips;
- solenoid valves operated in a pulsating mode to obviate the need for a flow meter and pressure regulator, and
- pairs of short tubing having fitting connections on a same plane.

While one embodiment of the present invention has been illustrated in the accompanying drawings and described herein above, it will be appreciated by those skilled in the art that various modifications, alternate constructions and equivalents may be employed. Therefore, the above description and illustrations should not be construed as limiting the scope of the invention, which is defined in the appended claims.

What is claimed is:

1. A tank for use in a refrigerant management system comprising:

a hollow structure;

a first and second tank head manifolds mounted to respective ends of said hollow structure, and conduits extending inside said hollow structure connecting said first tank head manifold to said second tank head manifold.

2. The tank as claimed in claim 1, wherein;

said first tank head manifold comprising a service port connection and filter connections;

said second thank head manifold comprising first and second compressor connections, condenser coil connections and a tank connection; and said conduits comprising manifold connections between one of said filter connections and said first compressor connection.

3. The tank as claimed in claim 2 wherein said conduits also comprising manifold connections between one of said filter connections and said second compressor connection.

4. The tank as claimed in claim 2, wherein said filter connections are aligned along a first plane, said compressor connections are aligned along said first plane and said condenser coil connection are aligned along a second plane, at a right angle from said first plane.

5. A refrigerant management system comprising:

a service connection, a refrigerant filter; a compressor; a condenser coil and a tank;

a first tank head manifold mounted to said tank and connecting said service connection to said refrigerant filter;

a second tank head manifold mounted to said tank and connecting said compressor to said condenser coil and to said tank; and conduits inside said tank between said first and second tank head manifolds connecting said refrigerant filter to said compressor.

6. The refrigerant management system as claimed in claim 5, further comprising;

a first loop in said tank head manifolds and said conduits, configured for receiving refrigerant from said service port connection, for passing said refrigerant through said filter, through said compressor; through said condenser coil and into said tank; and a second loop in said tank head manifolds and said conduits, configured for receiving refrigerant from said tank, for passing said refrigerant through said condenser coil, through said compressor, through said filter and through said service port connection.

7. The refrigerant management system as claimed in claim 6, further comprising a fresh refrigerant reserve container connection on one of said tank head manifolds, and a third loop in said tank head manifolds and said conduits, configured for receiving fresh refrigerant from said fresh refrigerant reserve container connection, for passing said fresh refrigerant through said filter, through said compressor; through said condenser coil and into said tank.

8. The refrigerant management system as claimed in claim 7, further comprising a flush port on one of said tank head manifolds, and a fourth loop in said tank head manifolds and said conduits, configured for pulling refrigerant in said filter, in said condenser coil, in said tank and in said conduits through said flush port.

9. The refrigerant management system as claimed in claim 5, wherein said filter is a reversible flow filter.

10. The refrigerant management system as claimed in claim 5, further comprising solenoid operated valves mounted to said tank head manifolds.

11. The refrigerant management system as claimed in claim 5, wherein said filter is mounted to one of said tank head manifolds with a first pair of pieces of tubing, and said first pair of tubing having fittings aligned along a same plane of each other.

12. The refrigerant management system as claimed in claim 11, wherein said pieces of tubing in said first pair of pieces of tubing being a mirror images of each other.

13. The refrigerant management system as claimed in claim 12, wherein said pieces of tubing in said first pair of pieces of tubing being shorter in length than said filter.

14. The refrigerant management system as claimed in claim 11 wherein said compressor and said condenser coil being connected to one of said tank head manifolds by second and third pairs of pieces of tubing, respectively, and said pieces of tubing from each of said second and third pairs of pieces of tubing having fittings aligned along a same plane of each other.

15. The refrigerant management system as claimed in claim 14, wherein said pieces of tubing in said third pair of pieces of tubing being shorter in length than said condenser coil.

16. The refrigerant management system as claimed in claim 5, wherein said tank has a volume of 3.8 Litres.

17. The refrigerant management system as claimed in claim 16, being enclosed in a case, and wherein a weight thereof with said case being 55 lbs.

* * * * *